US007758380B2

(12) United States Patent
Wang et al.

(10) Patent No.: US 7,758,380 B2
(45) Date of Patent: Jul. 20, 2010

(54) STACKED ELECTRICAL CONNECTOR WITH IMPROVED SHELL FOR EMI PROTECTION

(75) Inventors: Li-Jiang Wang, Kunshan (CN); Jia-Yong He, Kunshan (CN); Zhong-Hua Yao, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/466,356

(22) Filed: May 14, 2009

(65) Prior Publication Data

US 2009/0286424 A1 Nov. 19, 2009

(30) Foreign Application Priority Data

May 16, 2008 (CN) ..... 2008 2 0036266
Jun. 18, 2008 (CN) ..... 2008 2 0038346

(51) Int. Cl.
*H01R 13/648* (2006.01)

(52) U.S. Cl. ..... 439/607.23; 439/607.55; 439/541.5

(58) Field of Classification Search ..... 439/541.5, 439/607.23, 607.24, 607.25, 607.53, 607.54, 439/607.55, 607.4
See application file for complete search history.

(56) References Cited

U.S. PATENT DOCUMENTS

| | | | | |
|---|---|---|---|---|
| 6,139,367 | A | 10/2000 | Yeh | |
| 6,540,563 | B1 * | 4/2003 | Hu et al. | 439/676 |
| 7,270,570 | B1 * | 9/2007 | Hamner et al. | 439/607.04 |
| 7,364,463 | B1 * | 4/2008 | Ju | 439/607.55 |
| 7,473,136 | B2 * | 1/2009 | Hu et al. | 439/607.01 |
| 7,588,445 | B2 * | 9/2009 | He et al. | 439/79 |
| 7,588,458 | B2 * | 9/2009 | He et al. | 439/541.5 |
| 2007/0243757 | A1 * | 10/2007 | Wan et al. | 439/541.5 |
| 2008/0176449 | A1 * | 7/2008 | Hu et al. | 439/607 |
| 2009/0305555 | A1 * | 12/2009 | Wang et al. | 439/541.5 |

FOREIGN PATENT DOCUMENTS

CN 2655454 Y 11/2004

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

A stacked electrical connector includes an upper mating port, a lower mating port, an insulative separate portion separating the upper and the lower mating ports, and an additional metal shell covering the separate portion. The upper and lower mating ports include first and second metal shells, respectively. The additional metal shell includes a main body shielding a front surface of the separate portion and a pair of side walls extending backwardly from the main body to abut against the opposite walls. At least one side wall includes a lower bending portion attached to the second metal shell in order to form a much larger grounding area for Electromagnetic Interference (EMI) protection.

17 Claims, 11 Drawing Sheets

STACKED ELECTRICAL CONNECTOR WITH IMPROVED SHELL FOR EMI PROTECTION

BACKGROUND OF THE INVENTION

1. Field of the Invention

This invention generally relates to an electrical connector, and more particularly to a stacked electrical connector with improved shell for excellent Electromagnetic Interference (EMI) protection.

2. Description of Related Art

U.S. Pat. No. 7,270,570 discloses a stacked electrical connector includes an upper port, a lower port and an insulative portion separating the upper and the lower ports. The upper port defines a first tongue potion, a plurality of first contact retained in the first tongue portion and a first metal shell enclosing the first tongue portion. The second port defines a plurality of second contacts and a second metal shell enclosing contact portions of the second contacts. However, with the high speed signal transmission, the first and the second contacts may occur cross-talk therebetween and may further result in signal confusion.

Hence, it is desired to have a stacked electrical connector with improved shell solving the problems above.

BRIEF SUMMARY OF THE INVENTION

A stacked electrical connector includes an upper mating port, a lower mating port, an insulative separate portion separating the upper and the lower mating ports, and an additional metal shell covering the separate portion. The upper mating port includes a first tongue portion, a plurality of first contacts retained in the first tongue portion and a first metal shell enclosing the first tongue portion. The lower mating port includes a second tongue portion, a plurality of second contacts retained in the second tongue portion and a second metal shell enclosing the second tongue portion. The separating portion includes a front surface and a pair of opposite walls perpendicular to the front surface. The additional metal shell includes a main body shielding the front surface of the separate portion and a pair of side walls extending backwardly from the main body to abut against the opposite walls. At least one side wall includes a lower bending portion attached to the second metal shell in order to form a much bigger grounding area for EMI protection.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
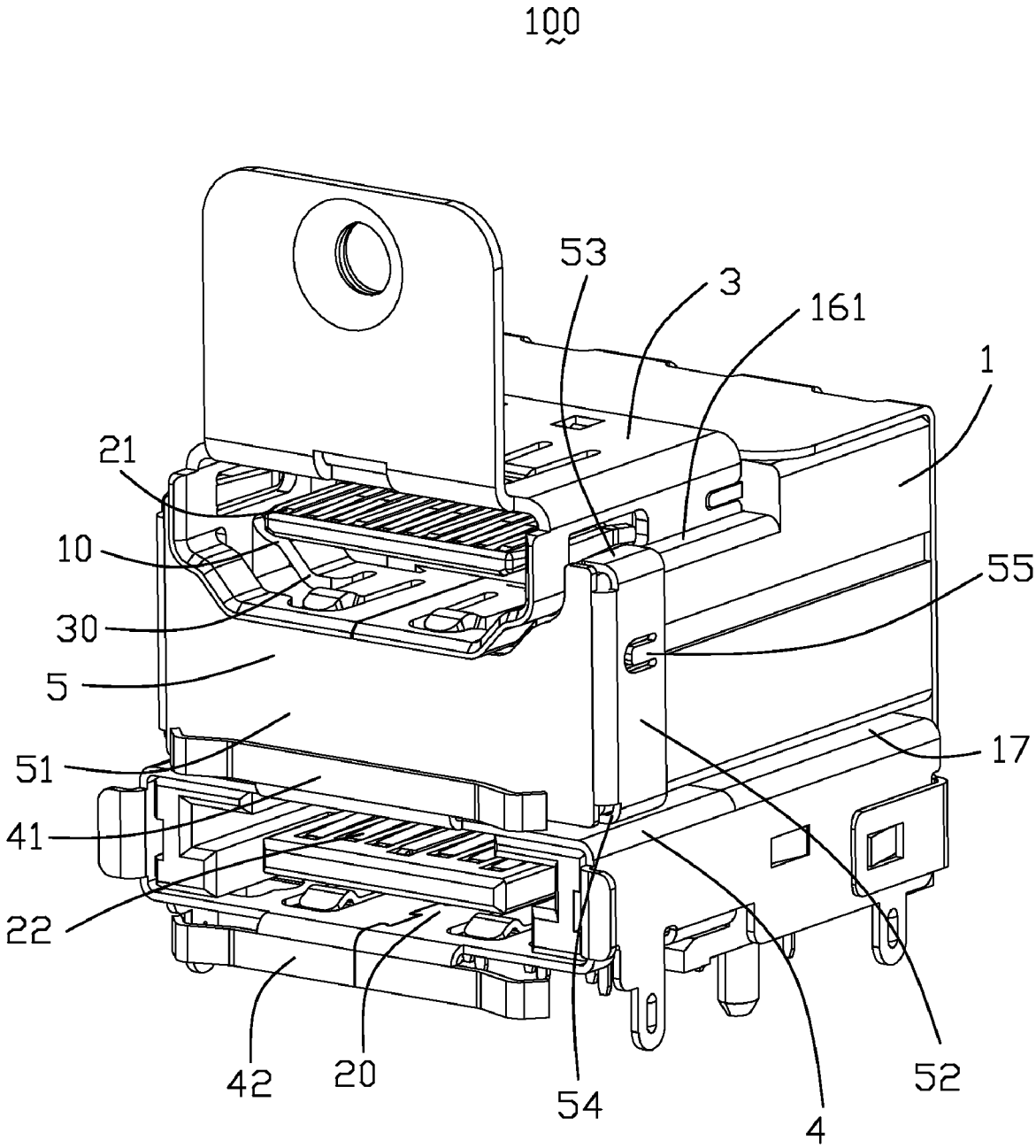
FIG. 1 is a perspective view of a stacked electrical connector according to a first embodiment of the present invention.
Figure 2:
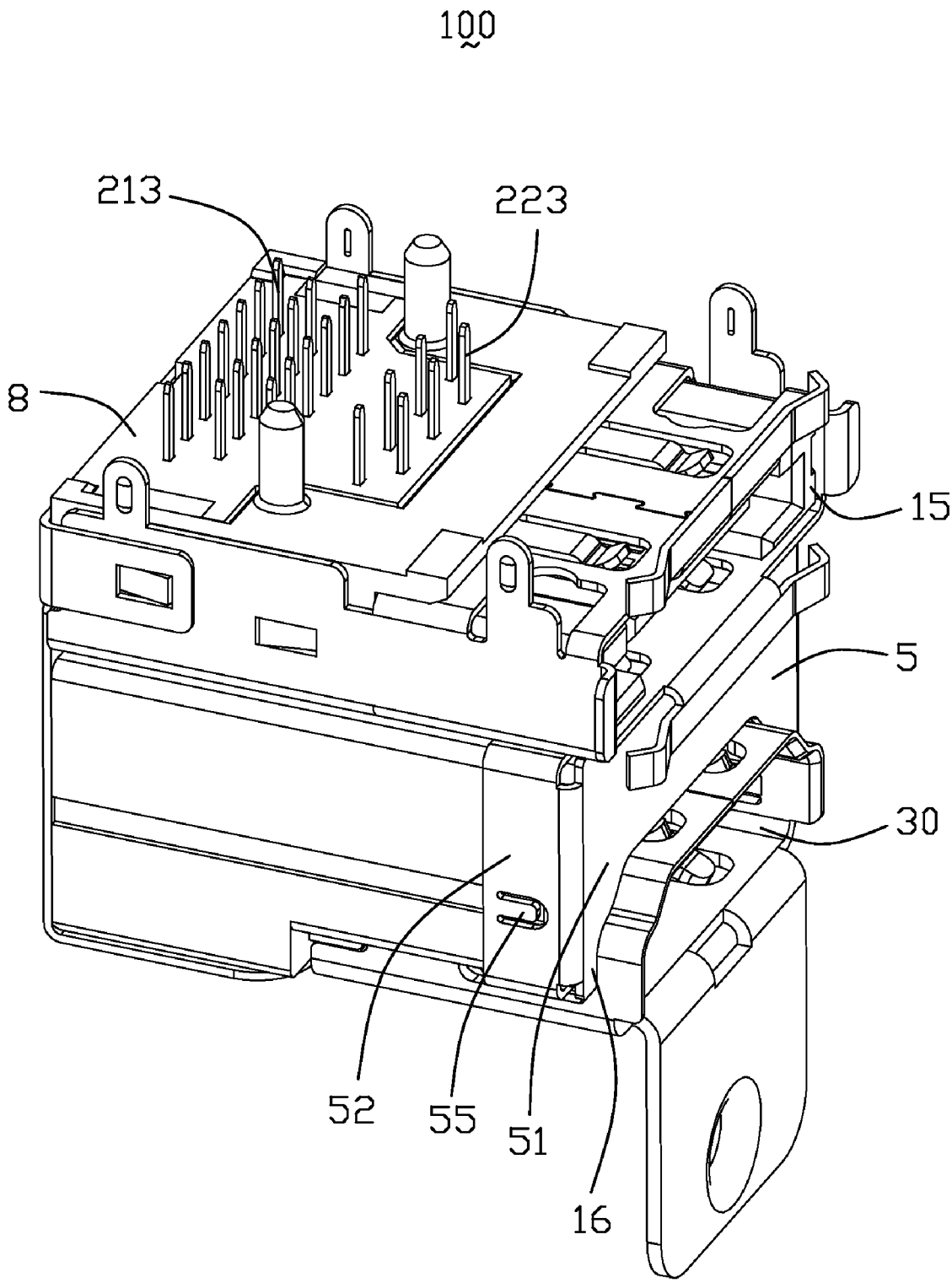
FIG. 2 is another perspective view of the stacked electrical connector, but viewed from another aspect.
Figure 3:
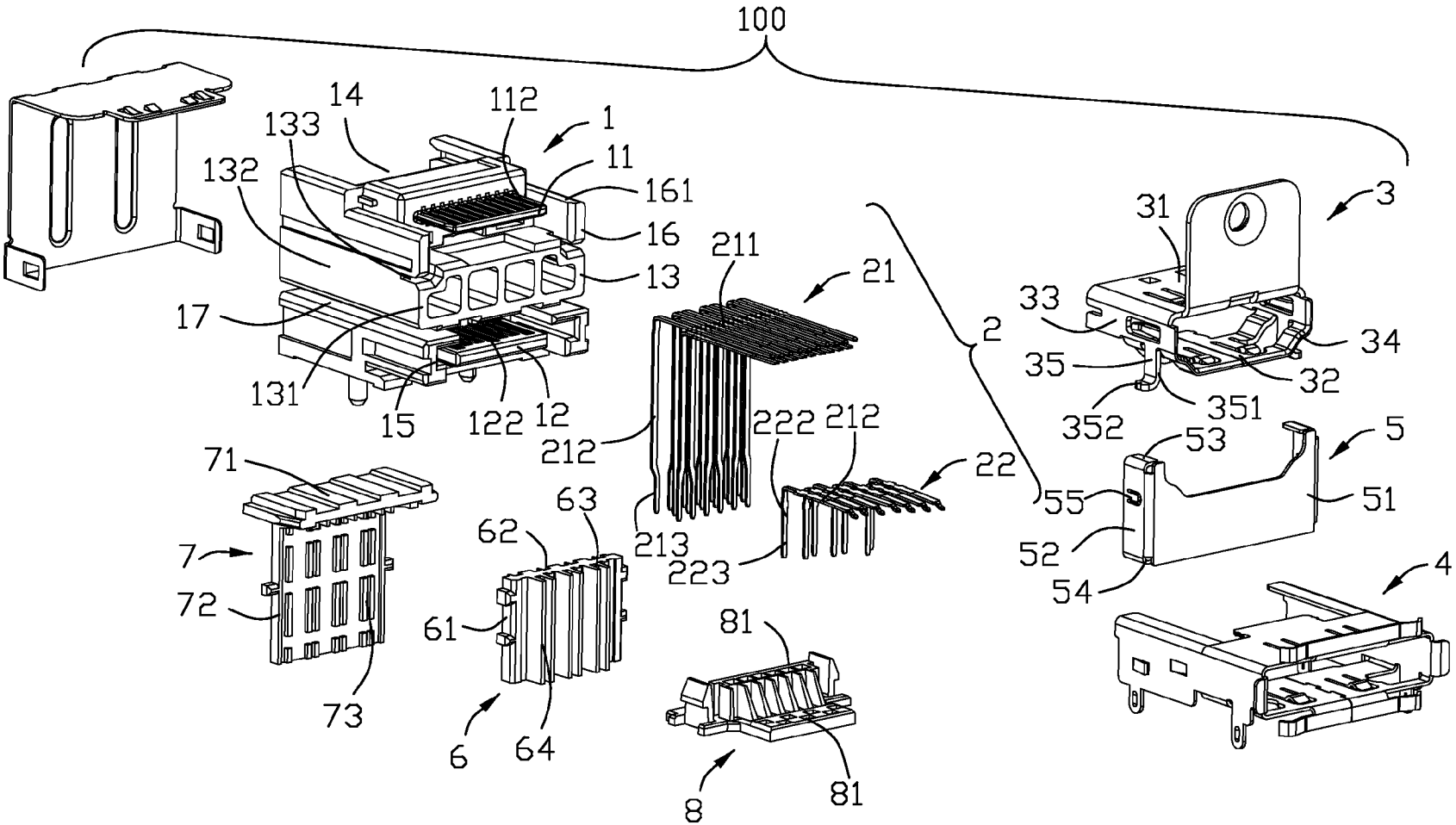
FIG. 3 is an exploded view of the stacked electrical connector.
Figure 4:
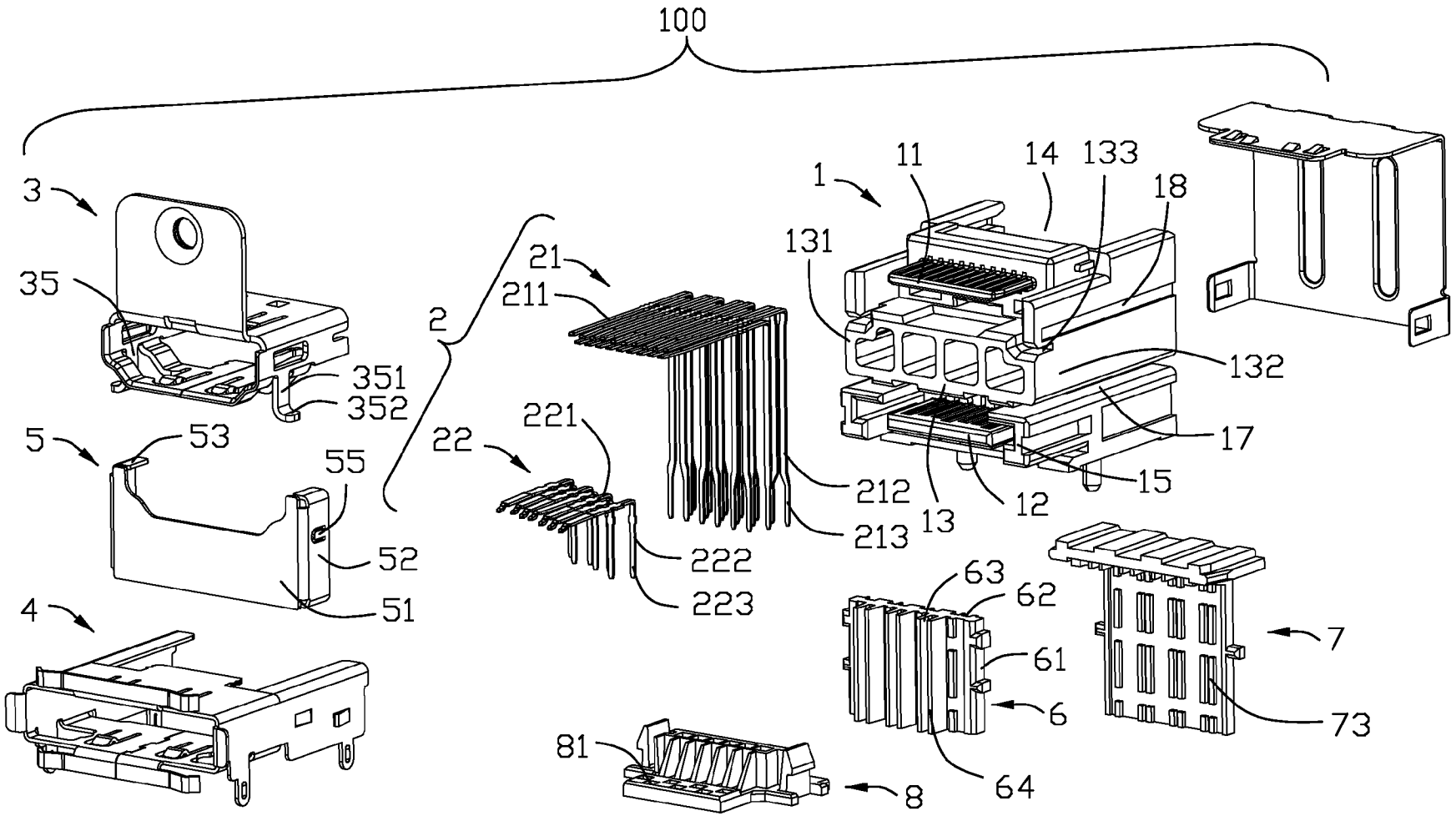
FIG. 4 is another exploded view of the stacked electrical connector similar to FIG. 3, while taken from another aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1 to 4, a stacked electrical connector 100 according to a first embodiment of present invention is disclosed. The stacked electrical connector 100 is adapted for being mounted on a printed circuit board (PCB) (not shown). The stacked electrical connector 100 includes an insulative housing 1, a plurality of contacts 2 retained in the insulative housing 1, a pair of first and second metal shells 3, 4 and an additional metal shell 5 partly covering the insulative housing 1.

The insulative housing 1 includes an upper tongue portion 11, a lower tongue portion 12 and an insulative separate portion 13 separating the upper and the lower tongue portions 11, 12. The upper tongue potion 11 defines a plurality first passageways 112 formed on both opposite sides thereof. The lower tongue portion 12 defines a plurality of second passageways 122 only formed on its upper side. The separate portion 13 includes a front surface 131, a pair of opposite walls 132 perpendicular to the front surface 131, and a pair of positioning slits 133 recessed from the front surface 131. A receiving chamber 14 is formed in the insulative housing 1 and is located at a rear side of the upper and the lower tongue portions 11, 12. A guiding wall 15 is disposed on the insulative housing 1 to surround the lower tongue portion 12. The upper and the lower tongue portions 11, 12 are located in parallel vertical planes and are parallel to the PCB. The insulative housing 1 further includes a pair of engaging portions 16 with the upper tongue portion 11 disposed between the pair of engaging portions 16. Each opposite wall 132 defines a slit 18 formed on a middle portion thereof and a slot 17 located over the lower tongue portion 12. The slot 17 extends through the opposite wall 132 along a front-to-rear direction for receiving the second metal shell 4.

The contacts 2 include a plurality of first contacts 21 received in the first passageways 112 and a plurality of second contacts 22 received in the second passageways 122. The first contacts 21 include two rows of first contact portions 211 accommodating in the first passageways 112, three rows of first retaining portions 212 perpendicular to the first contact portions 211, and three rows of first soldering tails 213 disposed at distal ends of the first retaining portions 212.

The second contacts 22 include a plurality of second contact portions 221 received in the second passageway 122, two rows of second retaining portions 222 perpendicular to the second contact portions 221 and two rows of soldering tails 223 disposed on the distal ends of the second retaining portions 222.

The first metal shell 3 encloses the upper tongue portion 11 in order to form a first insertion opening 30 therebetween. The first metal shell 3 together with the upper tongue portion 11 and the plurality of first contacts 21 form an upper mating port 10. The first metal shell 3 includes a top wall 31, a bottom wall 32 opposite to the top wall 31, a pair of side walls 33 extending downwardly from the top wall 31, and a pair of inclined walls 34 connecting the side walls 33 and the bottom wall 32. The side walls 33 include a pair of L-shaped wings 35 stamped from the inclined walls 34 and the bottom wall 32. Each wing 35 includes a vertical portion 351 and a horizontal portion 352 perpendicular to the vertical portion 351 wherein the vertical portion 351 is coplanar with the corresponding side wall 33. The wings 35 are received in the positioning slits 133 for retaining and positioning purpose. The side walls 33 are sandwiched between the pair of engaging portions 16 and engage with the pair of engaging portions 16 so that the first metal shell 3 can be stably fixed to the insulative housing 1.

The second metal shell 4 encloses the guiding wall 15 and includes a pair of upper and lower grounding springs 41, 42. The lower tongue portion 12, the plurality of second contacts 22, the guiding wall 15 and the second metal shell 4 jointly forms a lower mating port 20.

The additional metal shell 5 includes a main body 51 shielding the front wall 131 of the separate portion 13 and a pair of side walls 52 extending backwardly from main body 51. Each side wall 52 includes an upper bending portion 53 and a lower bending portion 54 inwardly extending from upper and lower edges of the side wall 52, respectively. The upper and the lower bending portions 53, 54 are perpendicular to the side walls 52 and the front wall 131. The additional metal shell 5 defines an upper recess configured with a bottom side of the first metal shell 3. In assembly, the additional metal shell 5 is attached to the insulative housing 1 along the front-to-rear direction. The upper bending portions 53 press against upper walls 161 of the separate portion 13. The lower bending portions 54 are received in the slot 17 and abut against the second metal shell 4 as a result that the additional metal shell 5 electrically and mechanically connects the second metal shell 4 to provide a large grounding area for EMI protection. Under this condition, the main body 51 falls behind front insertion surfaces of the first and the second metal shells 3, 4. Besides, in order to stably fix the additional metal shell 5 to the insulative housing 1, each side wall 52 is stamped to form a stop tab 55 for inwardly abutting against the slit 18 so that forwardly removable of the additional metal shell 5 can be prohibited.

In order to organize the first and the second retaining portions 212, 222, a plurality of first, second and third spacers 6, 7, 8 are provided. The first spacer 6 includes a base 61, a pair of first and second fastening slots 62, 63 located on opposite sides of the base 61, and a plurality of protrusions 64 extending from the base 61. The second spacer 7 includes a horizontal mounting portion 71 and a pressing portion 72 perpendicular to the horizontal mounting portion 71. A plurality of projections 73 are formed on an inner side of the pressing portion 72. The third spacer 8 defines five rows of through holes 81.

Figure 5:
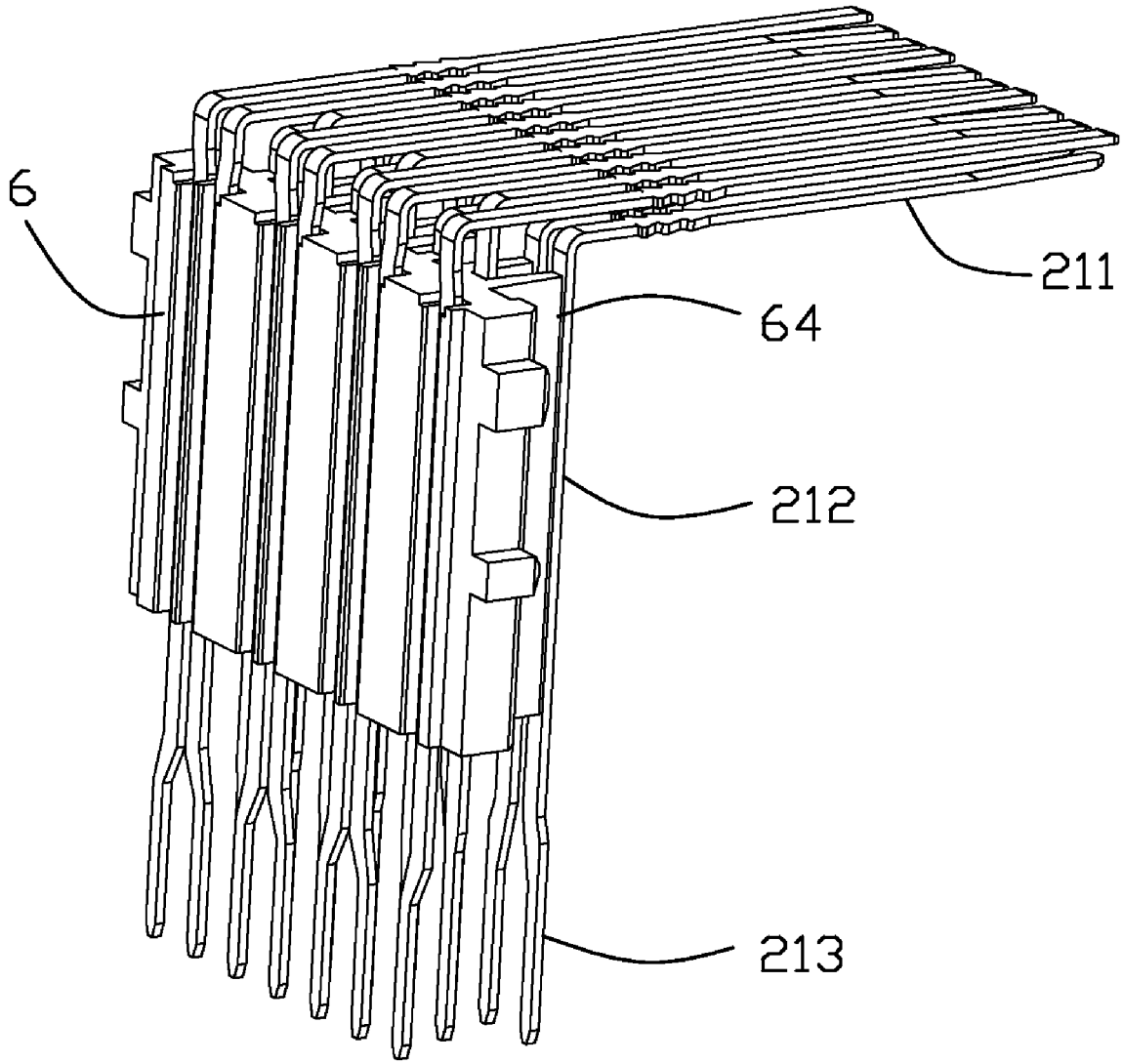
FIG. 5 is an enlarged view of a plurality of first contacts mating with a first spacer.
Figure 6:
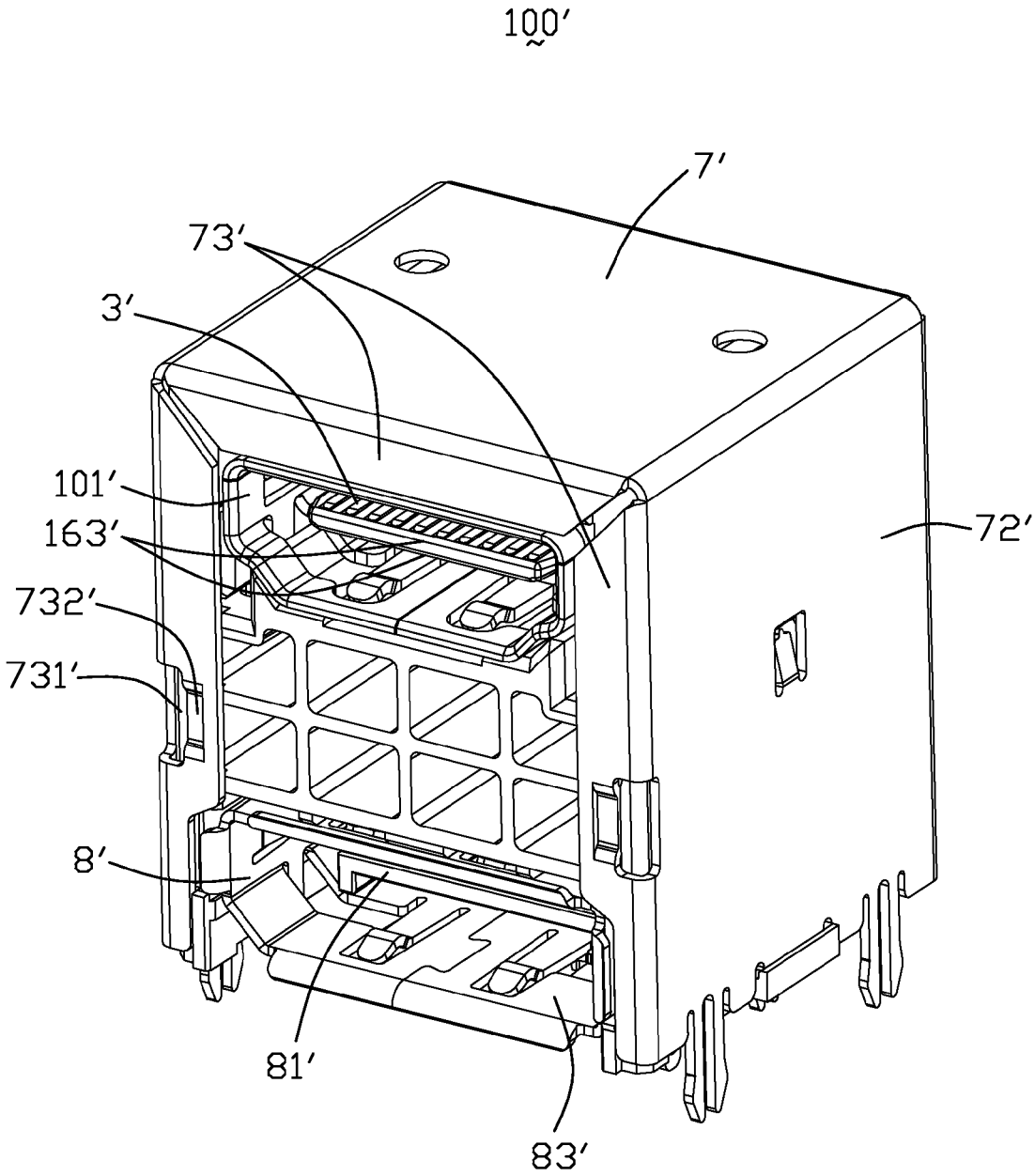
FIG. 6 is a perspective view of another stacked electrical connector according to a second embodiment of the present invention.
Figure 7:
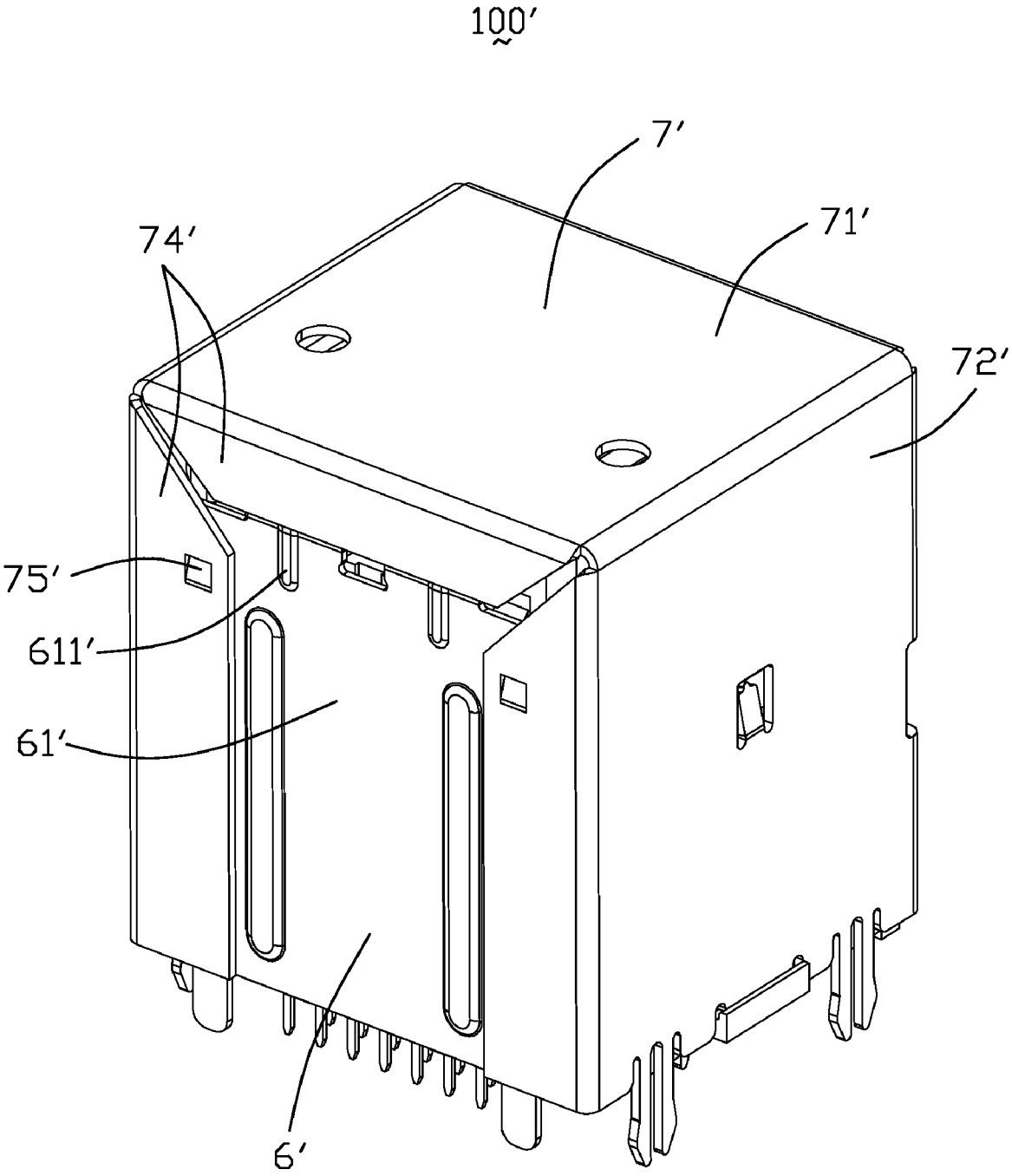
FIG. 7 is another perspective view of the stacked electrical connector according to the second embodiment, but viewed from another aspect.
Figure 8:
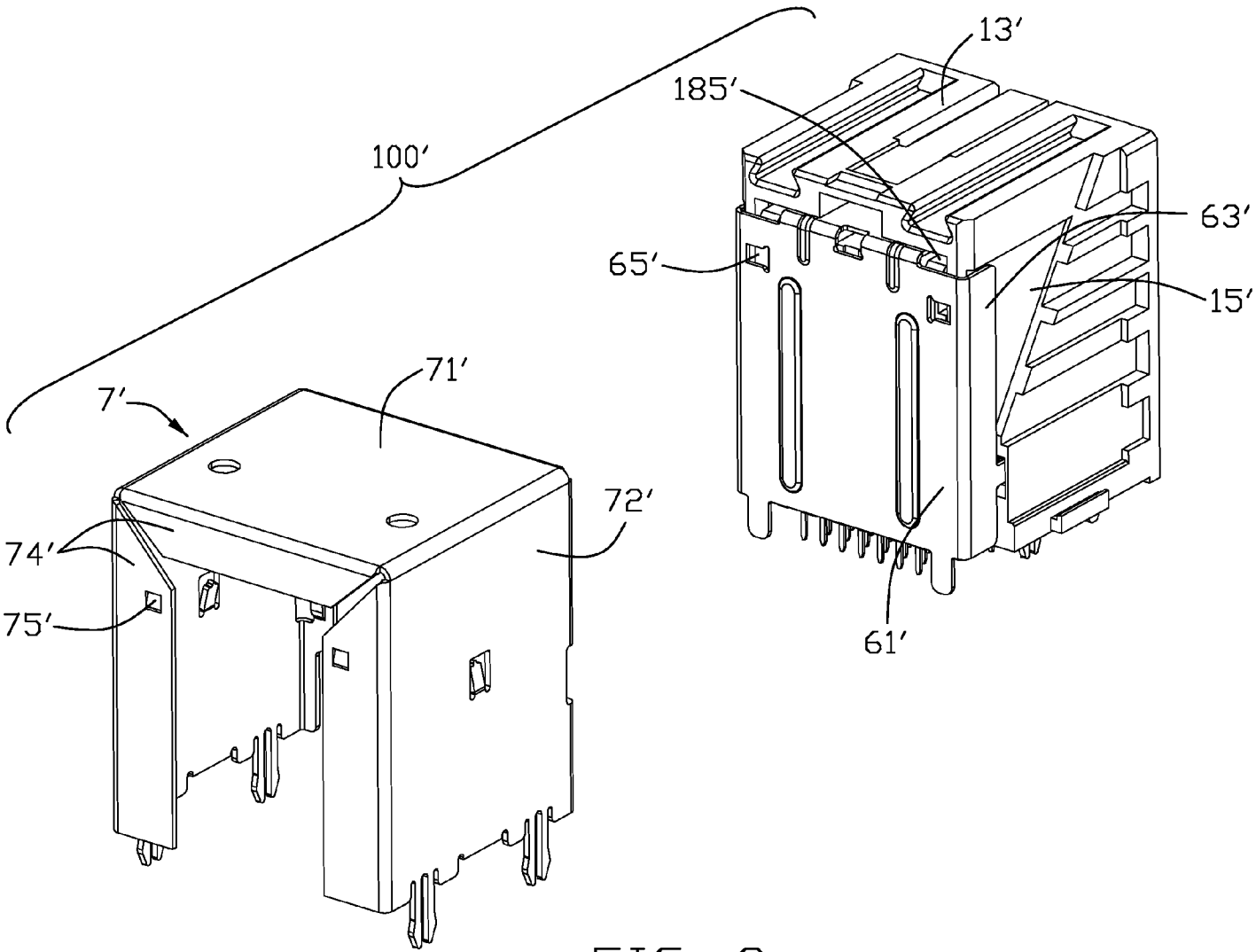
FIG. 8 is a part exploded view of the stacked electrical connector according to the second embodiment showing an outer shell apart therefrom.
Figure 9:
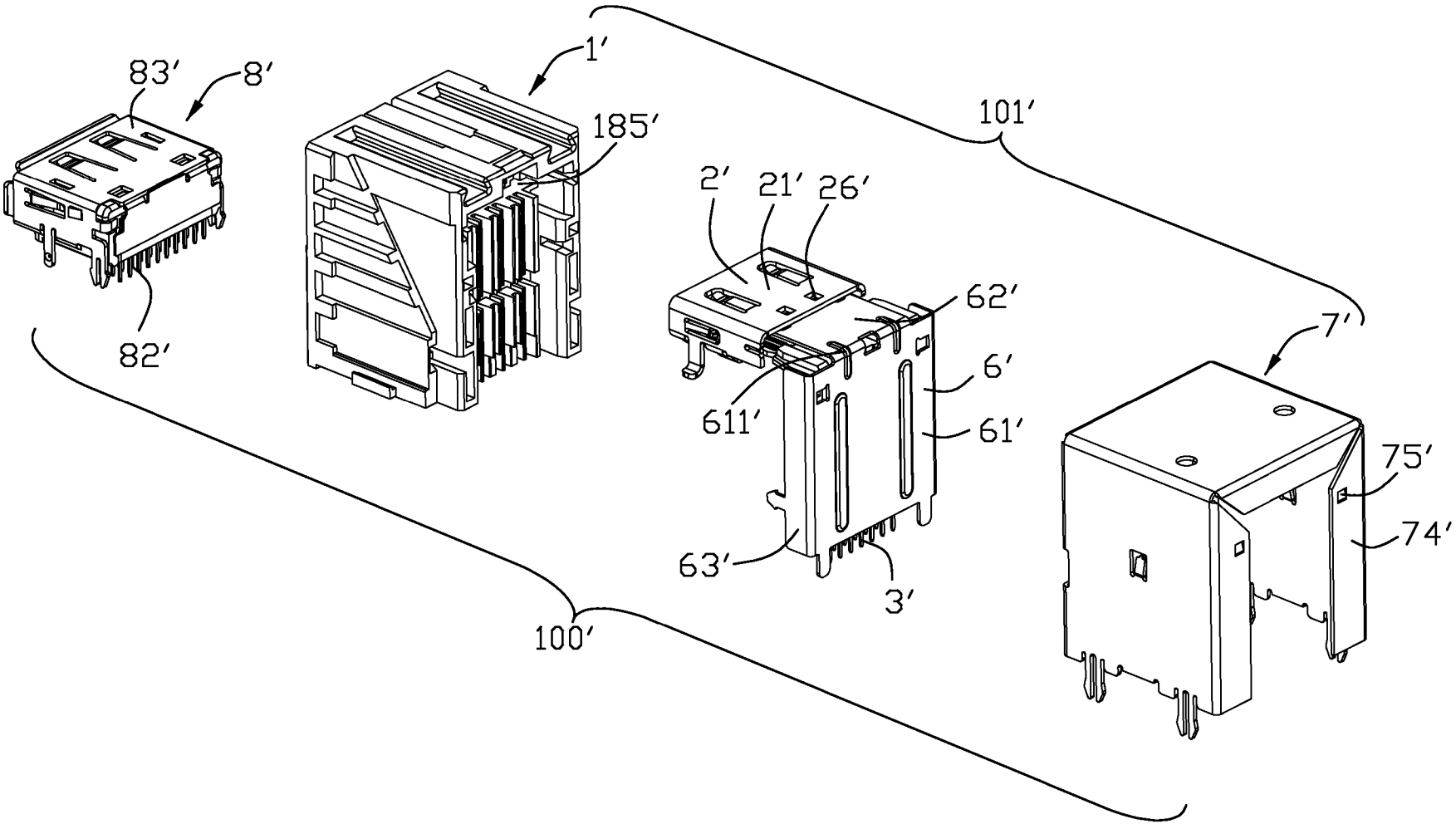
FIG. 9 is a part exploded view of the stacked electrical connector according to the second embodiment further separating a second connector, a first metal shell and a rear metal shell.
Figure 10:
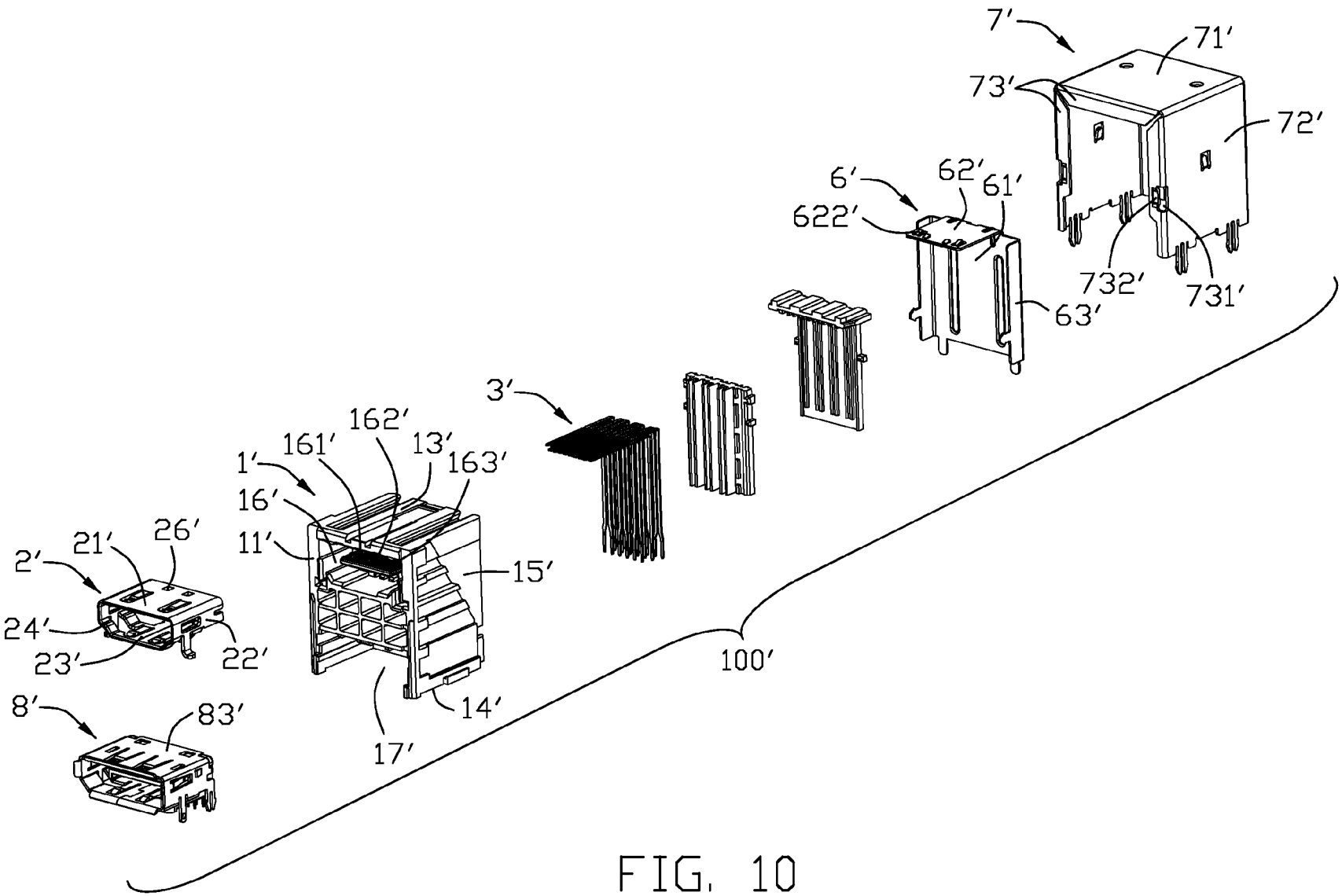
FIG. 10 is an exploded view of the stacked electrical connector according to the second embodiment of the present invention.
Figure 11:
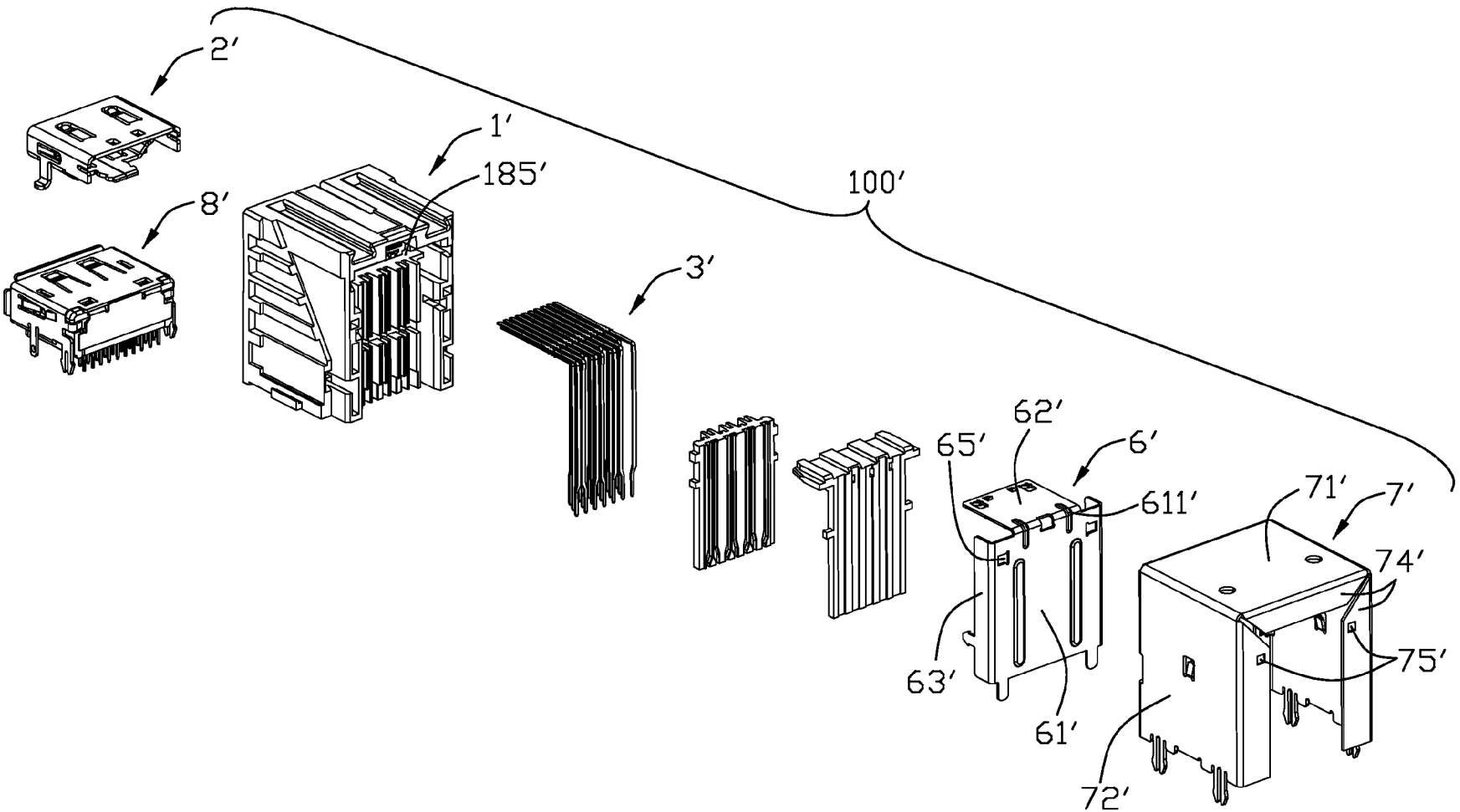
FIG. 11 is another exploded view similar to FIG. 10, while taking from another aspect.

Referring to FIG. 5, in assembly, the first and the second spacers 6, 7 are received in the receiving chamber 14 of the insulative housing 1 under a condition that the protrusions 64 resist against the most inner first retaining portions 212, and the middle first retaining portions 212 are received in the second fastening slots 63, and the farthest first retaining portions 212 are received in the first fastening slots 62. The second spacer 7 is fixed to the first spacer 6 through the projections 73 mating with the first fastening slots 62. The first and the second soldering tails 213, 223 are arranged extending through the through holes 81 for being mounted to a PCB.

Referring to FIGS. 6-10, another stacked electrical connector 100' according to a second embodiment of the present invention is disclosed. The stacked electrical connector 100' includes an upper connector 101', a lower connector 8' and an outer metal shell 7' covering the out sides of the upper and lower connectors 101', 8'. The lower connector 8' includes a U-shaped tongue plate 81', a plurality of second contacts 82' fixed to the tongue plate 81' and a second metal shell 83' enclosing the tongue plate 81'.

The upper connector 101' includes an insulative housing 1, a plurality of first contacts 3' retained in the insulative housing 1', a first metal shell 2' and a rear metal shell 6' fixed to the first metal shell 2'. The insulative housing 1' defines a front wall 11', a first receiving cavity 16' recessed from the front wall 11' for receiving the first metal shell 2', and a second receiving cavity 17' located below the first receiving cavity 16' for receiving the lower connector 8'. The second receiving cavity 17' extends through a mounting wall 14' and the front wall 11' to be opened to the outside. The insulative housing 1' includes a first tongue portion 162' extending to the first receiving cavity 16' wherein the first tongue portion 162' defines a plurality of first passageways 161' formed on both opposite surfaces 163' thereof for receiving the first contacts 3'. A retaining slit 185' is embeddedly defined under a top wall 13' of the insulative housing 1' and communicating with the first receiving cavity 16' for receiving the rear metal shell 6'.

The first metal shell 2' is similar to the first metal shell 3' of the first embodiment and includes a top wall 21', a bottom wall 23', a pair of side walls 22' extending downwardly from the top wall 21', and a pair of inclined walls 24' connecting the side walls 22' and the bottom wall 23'. The top wall 21' defines a pair of through holes 26' located at the rear side thereof.

The rear metal shell 6' includes a rear portion 61' and a horizontal fixing portion 62' extending forwardly from a top edge of the rear portion 61'. In order to enhance structure of the rear metal shell 6', a pair of reinforce ribs 611' are formed to connect the rear portion 61' and the fixing portion 62'. The fixing portion 62' includes a pair of protrusions 622' for locking with the through holes 26' so that the fixing portion 62' and the first metal shell 2' can be combined together. The rear portion 61' further includes a pair of extending portions 63' extending forwardly from lateral edges thereof. In assembly, the first metal shell 2' is received in the first receiving cavity 16' along a front-to-rear direction to enclose the first tongue portion 162'. The rear metal shell 6' is assembled to the insulative housing 1' along a rear-to-front direction with the fixing portion 62' received in the retaining slit 185'. Besides, the extending portions 63' abut against out side walls 15' of the insulative housing 1' for fixation as well. The rear metal shell 6' is electrically and mechanically connected to the first metal shell 2'.

The outer metal shell 7' includes a top wall 71' attached to the corresponding top wall 13' of the insulative housing 1' and a pair of side walls 72' extending downwardly from the top wall 71'. Each side wall 72' and the top wall 71' include a back wall 74' bending inwardly from corresponding peripheral edges thereof to overlap the rear portion 61' of the rear metal shell 6'. The back wall 74' is stamped to form a pair of spring tabs 75' for abutting against corresponding recesses 65' of the rear portion 61' as a result that the outer metal shell 7' mechanically connects the rear metal shell 6' which further connects the first metal shell 2' to jointly form a much bigger grounding area for EMI protection. The outer metal shell 7' includes a plurality of bending sections 73' extending inwardly from front lateral edges of the side walls 72' and the top wall 71'. The bending sections 73' extending from the top wall 71' is located above the first metal shell 2' while mechanically connecting the first metal shell 2'. Each bending section 73' defines a through hole 731' and a curved girder 732' communicating with the through hole 731' under a condition that the curved girder 732' is stamped towards the front wall 11' of the insulative housing 1' to abut against the insulative housing 1'. As a result, the outer metal shell 7' can be stably fixed to the out peripheral walls of the insulative housing 1'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A stacked electrical connector for being mounted on a printed circuit board (PCB), comprising:

an upper mating port including a first horizontal tongue portion, a plurality of first contacts retained in the first tongue portion and a first metal shell enclosing the first tongue portion;

a lower mating port including a second horizontal tongue portion, a plurality of second contacts retained in the second tongue portion and a second metal shell enclosing the second tongue portion;

an insulative separate portion separating the upper and the lower mating ports, the separating portion comprising a front surface and a pair of opposite walls perpendicular to the front surface; and an additional metal shell comprising a main body shielding the front surface of the separate portion and a pair of side walls extending backwardly from the main body to be fixed to the opposite walls; wherein at least one side wall of the additional metal shell comprises a lower bending portion perpendicularly extending inwardly from a bottom edge of the side wall so that the lower bending portion is attached to the second metal shell.

2. The stacked electrical connector according to claim 1, wherein the lower bending portion is both perpendicular to the side wall and the main body.

3. The stacked electrical connector according to claim 1, wherein each opposite wall of the separate portion defines a slit and each side wall of the additional metal shell has a stop tab inwardly extending into the slit for preventing forward removable of the additional metal shell.

4. The stacked electrical connector according to claim 1, wherein the first metal shell comprises opposite top and bottom walls, a pair of side walls extending downwardly from lateral sides the top wall and a pair of inclined walls connecting the side walls and the bottom wall, the additional metal shell defining an upper recess configured with the bottom wall and the pair of inclined walls.

5. The stacked electrical connector according to claim 1, wherein the separating portion comprises an upper wall and the side wall of the additional metal shell has upper bending portion pressing against the upper wall under a condition that the upper and lower bending portions are parallel to each other.

6. The stacked electrical connector according to claim 1, further comprising an insulative housing with the first and the second tongue portions extending therefrom, the insulative housing defining a slot over the second tongue portion to both receive a top wall of the second metal shell and the lower bending portion of the additional metal shell.

7. The stacked electrical connector according to claim 1, wherein the insulative housing comprises a pair of engaging portions with the first tongue portion disposed therebetween, the first metal shell comprising a pair of side portions located between the engaging portions and abutting against the engaging portions.

8. The stacked electrical connector according to claim 7, wherein the separate portion defines a pair of positioning slits recessed from the front surface, the pair of side portions employing a pair of L-shaped wings received in the positioning slits for positioning purpose.

9. The stacked electrical connector according to claim 1, wherein the main body of the additional metal shell falls behind insertion surfaces of the first and the second metal shells.

10. The stacked electrical connector according to claim 9, wherein the second metal shell comprises a pair of upper and lower grounding springs under a condition that the upper grounding spring overlaps the main body along a front-to-rear direction.

11. A stacked electrical connector, comprising:

an insulative housing defining a first receiving cavity, a tongue portion extending into the receiving cavity and a retaining slit communicating with the first receiving cavity;

a plurality of first contacts retained in the tongue portion;

a first metal shell received in the receiving cavity to enclose the tongue portion;

another connector mating port located below the receiving cavity and comprising a second metal shell;

a rear metal shell comprising a rear portion attached to a rear wall of the insulative housing and a horizontal fixing portion extending forwardly from the rear wall under a condition that the horizontal fixing portion is received in the retaining slit to electrically and mechanically connect the first metal shell; and an outer metal shell comprising a top wall and a pair of side walls jointly covering peripheral walls of the insulative housing; wherein the outer metal shell further comprises at least one back wall overlapping and abutting against the rear portion of the rear metal shell.

12. The stacked electrical connector according to claim 11, wherein the at least one back wall is located at an out side of the rear portion and comprises a spring tab extending inwardly to abut against the rear portion.

13. The stacked electrical connector according to claim 12, wherein the rear portion defines a recess to receive the spring tab.

14. The stacked electrical connector according to claim 11, wherein the back wall extend inwardly from a lateral edge of the one of the side wall.

15. The stacked electrical connector according to claim 11, wherein the outer metal shell includes a pair of bending sections extending inwardly from front lateral edges of the side walls, each bending section defines a through hole and a curved girder communicating with the through hole under a condition that the curved girder is stamped towards a front wall of the insulative housing to abut against the insulative housing.

16. The stacked electrical connector according to claim 15, wherein the receiving cavity is recessed from the front wall and the outer metal shell further comprises an upper bending section extending downwardly from an upper edge of the top wall under a condition that the upper bending section is located above the first metal shell while mechanically connecting the first metal shell.

17. The stacked electrical connector according to claim 11, wherein the rear metal shell comprises a pair of reinforce ribs connecting the rear portion and the horizontal fixing portion to enhance structure of the rear metal shell.

* * * * *